US010626834B2

(12) United States Patent
Liu et al.

(10) Patent No.: US 10,626,834 B2
(45) Date of Patent: Apr. 21, 2020

(54) FUEL INJECTOR FOR AN INTERNAL COMBUSTION ENGINE

(71) Applicant: GM Global Technology Operations LLC, Detroit, MI (US)

(72) Inventors: Zhongyi Liu, Troy, MI (US); Michael P. Balogh, Novi, MI (US); Nicholas P. Irish, Commerce, MI (US); Matthew T. Hamilton, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 50 days.

(21) Appl. No.: 15/499,393

(22) Filed: Apr. 27, 2017

(65) Prior Publication Data

US 2017/0321645 A1 Nov. 9, 2017

Related U.S. Application Data

(60) Provisional application No. 62/331,403, filed on May 3, 2016.

(51) Int. Cl.
*F02M 61/16* (2006.01)
*F02M 21/02* (2006.01)
(Continued)

(52) U.S. Cl.
CPC ..... *F02M 61/166* (2013.01); *C23C 28/322* (2013.01); *C23C 28/341* (2013.01); *C23C 28/343* (2013.01); *C23C 28/347* (2013.01); *F01L 3/04* (2013.01); *F02M 21/02* (2013.01); *F02M 61/188* (2013.01);
(Continued)

(58) Field of Classification Search
CPC ..... C23C 28/00; C23C 28/322; C23C 28/341; C23C 28/343; C23C 28/347; F01L 3/04; F02F 3/00; F02M 21/02; F02M 2200/9038; F02M 61/166; F02M 61/18; F02M 61/1853; F02M 61/188; F02M 2200/05
See application file for complete search history.

(56) References Cited

U.S. PATENT DOCUMENTS 6,802,457 B1 * 10/2004 Campion ..... C23C 14/025 239/533.2
8,006,715 B2 8/2011 Shafer et al.
(Continued)

FOREIGN PATENT DOCUMENTS

CN 101802387 A 8/2010
CN 102265023 A 11/2011
(Continued)

OTHER PUBLICATIONS

First Office Action for corresponding Chinese Patent Application No. 201710304834.5 dated Jan. 11, 2019 with English language machine translation, 21 pages.

*Primary Examiner* — Jacob M Amick
*Assistant Examiner* — Ruben Picon-Feliciano

(57) ABSTRACT

A vehicle component includes a surface that is configured to contact a fuel containing ethanol and zinc ions. A sacrificial carbon layer is disposed on the surface. The sacrificial carbon layer has a thickness of greater than or equal to about 250 nm to less than or equal to about 5 μm. The sacrificial carbon layer includes carbon that is configured to complex and solubilize ZnO deposited on the surface, wherein the ZnO forms from the zinc ions carried by the fuel.

17 Claims, 4 Drawing Sheets

(51) Int. Cl.

| | |
|---|---|
| ***F01L 3/04*** | (2006.01) |
| ***C23C 28/00*** | (2006.01) |
| ***F02M 61/18*** | (2006.01) |
| ***F02F 3/00*** | (2006.01) |

(52) U.S. Cl.
CPC ..... *F02M 61/1853* (2013.01); *F02F 3/00* (2013.01); *F02M 61/18* (2013.01); *F02M 2200/05* (2013.01); *F02M 2200/9038* (2013.01)

(56) References Cited

U.S. PATENT DOCUMENTS

| | | | | |
|---|---|---|---|---|
| 2008/0220257 | A1* | 9/2008 | Dekempeneer | C23C 16/0272 428/408 |
| 2009/0140079 | A1* | 6/2009 | Bertini | F02M 51/0675 239/584 |
| 2009/0302136 | A1 | 12/2009 | Song | |
| 2010/0007206 | A1* | 1/2010 | Wodrich | B22D 19/08 305/198 |
| 2010/0210745 | A1* | 8/2010 | McDaniel | C09D 5/008 521/55 |
| 2010/0242343 | A1* | 9/2010 | Tock | C10L 1/10 44/357 |
| 2011/0253107 | A1 | 10/2011 | Gebhard et al. | |
| 2014/0196603 | A1 | 7/2014 | Von Der Osten-Sack | |
| 2015/0114353 | A1 | 4/2015 | Von Der Osten-Sack et al. | |

FOREIGN PATENT DOCUMENTS

| | | | |
|---|---|---|---|
| CN | 103717895 | A | 4/2014 |
| CN | 104334866 | A | 2/2015 |
| CN | 107339183 | A | 11/2017 |
| DE | 102017109452 | A1 | 11/2017 |

* cited by examiner

FUEL INJECTOR FOR AN INTERNAL COMBUSTION ENGINE

CROSS-REFERENCE TO RELATED APPLICATIONS

This application claims the benefit of U.S. Provisional Application No. 62/331,403, filed on May 3, 2016. The entire disclosure of the above application is incorporated herein by reference.

FIELD

The present disclosure is related to fuel injectors for direct injection spark ignition engines. More particularly, the present disclosure relates to a coating on a valve member to reduce chemical and physical wear degradation of the sealing capability of the valve member.

BACKGROUND

This section provides background information related to the present disclosure which is not necessarily prior art.

Vehicles powered by internal combustion engines have a fuel delivery system that stores and delivers fuels to the internal combustion engines. In general, the fuel system includes units that include a fuel tank, a fuel pump, a fuel filter, a sending unit, a fuel rail, fuel injectors, and a series of conduits that transports fuel between the units. Because various units of the fuel system contact fuel, some at elevated temperatures, the units desirably withstand thermal-induced and/or fuel-induced corrosion.

Spark Ignited Direct Injection (SIDI) is a variant of fuel injection employed in some non-diesel two and four stroke internal combustion engines. The fuel is highly pressurized, and injected via a common rail fuel line directly into the combustion chamber of each cylinder. Some engines may have multi-point fuel injection that injects fuel into an intake tract, or cylinder port. Directly injecting fuel into a combustion chamber requires high pressure injection; low pressure can be used to inject fuel into an intake tract or cylinder port. Some advantages of SIDI engines are increased fuel efficiency and high power output. Some SIDI engines may have reduced emissions levels. Such advantages are achieved, in part, by precise control over the amount and timing of fuel injected into the combustion chamber.

Moreover, many vehicles have internal combustion engines that are powered at least partially, if not completely, by alternative fuels, which help reduce petroleum use and greenhouse gas emissions. Some vehicles, i.e., flexible-fuel vehicles or dual-fuel vehicles (also known as "flex-fuel vehicles") have internal combustion engines that are designed to run on more than one fuel, such as a blend of gasoline and an alternative fuel.

One such alternative fuel is ethanol, which may be generated from corn, grain, or other biomass sources. Whereas some vehicles have internal combustion engines that run on pure 100% ethanol, i.e., E100 fuels, other vehicles have internal combustion engines that run on ethanol blended fuels, such as E5 (5% ethanol), E7 (7% ethanol), E10 (10% ethanol), E20 (20% ethanol), E22 (22% ethanol), E25 (25% ethanol), E70 (70% ethanol), E75 (75% ethanol), E85 (85% ethanol), or E95 (95% ethanol) fuels. Because ethanol causes corrosion on various materials, vehicle components, such as units of fuel delivery systems, that contact fuels containing ethanol benefit from coatings that resist corrosion. With the increasing use of fuels containing ethanol throughout the world, there is a need for new coatings that withstand corrosion caused by ethanol or a combination of ethanol and heat.

SUMMARY

This section provides a general summary of the disclosure, and is not a comprehensive disclosure of its full scope or all of its features.

The current technology provides a vehicle component that includes a surface that is configured to contact a fuel containing ethanol and zinc ions, and a sacrificial carbon layer disposed on the surface. The sacrificial carbon layer has a thickness of greater than or equal to about 250 nm to less than or equal to about 5 μm. The sacrificial carbon layer includes carbon that is configured to complex with and solubilize ZnO deposited on the surface, wherein the ZnO forms from the zinc ions carried by the fuel.

In various embodiments, the surface includes a steel alloy or a ceramic.

In various embodiments, the sacrificial carbon layer includes a dopant selected from the group consisting of calcium (Ca), zinc (Zn), iron (Fe), boron (B), tungsten (W), platinum (Pt), gold (Au), silver (Ag), copper (Cu), chromium (Cr), aluminum (Al), titanium (Ti), nitrogen (N), phosphorous (P), silicon (Si), cobalt (Co), vanadium (V), zirconium (Zr), niobium (Nb), molybdenum (Mo), hafnium (Hf), tantalum (Ta), rhenium (Re), and combinations thereof.

In various embodiments, the sacrificial carbon layer includes a chelator selected from the group consisting of ethylenediaminetetraacetic acid (EDTA), ethylene glycol-bis(β-aminoethyl ether)-N,N,N',N'-tetraacetic acid (EGTA), diethylenetriaminepentaacetic acid (DTPA), N,N-bis(carboxymethyl)glycine (NTA) glutamic acid, N,N-diacetic acid (GLDA), hydroxyethylethylenediaminetriacetic acid (HEDTA), ethanoldiglycinic acid (EDG), 1,3-propylenediaminetetraacetic acid (PDTA), glucoheptonic acid, aspartic acid-N,N-diacetic acid (ASDA), 1,2-diaminocyclohexane-N,N,N',N'-tetraacetic acid (CDTA), ethylenediamine-N,N',diorthohydroxyphenylacetic acid (EDDHA), ethylenediamine-N,N',diorthohydroxyparamethylphenylacetic acid (EDDHMA), ethlenediamine-N,N'-disuccinic acid (EDDS), N,N'-bis(2-hydroxybenzyl)-ethylenediamine-N,N'-diacetic acid (HBED), N-hydroxyethylethylenediamine, N,N',N'-triacetic acid (HEDTA), imino-N,N-disuccinic acid (IDS), methylglycine-N,N-diacetic acid (MGDA), triethlenetetraamine-N,N,N',N'',N''',N'''-hexaacetic acid (TTHA), and combinations thereof.

In various embodiments, the sacrificial carbon layer is disposed directly on the surface of the vehicle component.

In various embodiments, the surface is a surface of a piston, an intake valve, a fuel injector, a spark plug, an exhaust valve, or a combination thereof.

In various embodiments, the vehicle component includes an adhesive layer disposed directly onto the surface of the vehicle component and a protective tungsten carbide carbon (WCC) layer disposed directly on the adhesive layer, wherein the protective WCC layer defines the surface and the sacrificial carbon layer is disposed directly the protective WCC layer.

In various embodiments, the vehicle component is a fuel injector, an intake valve, an exhaust valve, a cylinder, a piston, a spark plug, a fuel pump, a sending unit, a fuel tank, a ring, a gasket, or a combination thereof.

The current technology also provides a fuel injector for an internal combustion engine that includes an injector body having an inlet, an outlet, and a passageway for fuel to flow from the inlet to the outlet; a movable valve portion disposed in the passageway that translates between an open position and a closed position, wherein the movable valve portion defines a seat contacting element having an outermost exposed surface that has a sacrificial carbon layer; and a valve seat defined at the outlet, wherein in the closed position, the movable valve portion sealingly engages with the valve seat and in the open position, the movable valve portion is spaced from the valve seat to open the fuel injector permitting fuel to flow through the outlet.

In various embodiments, the sacrificial carbon layer further includes a chelating agent selected from the group consisting of ethylenediaminetetraacetic acid (EDTA), ethylene glycol-bis(β-aminoethyl ether)-N,N,N',N'-tetraacetic acid (EGTA), diethylenetriaminepentaacetic acid (DTPA), N,N-bis(carboxymethyl)glycine (NTA) glutamic acid, N,N-diacetic acid (GLDA), hydroxyethylethylenediaminetriacetic acid (HEDTA), ethanoldiglycinic acid (EDG), 1,3-propylenediaminetetraacetic acid (PDTA), glucoheptonic acid, aspartic acid-N,N-diacetic acid (ASDA), 1,2-diaminocyclohexane-N,N,N',N'-tetraacetic acid (CDTA), ethylenediamine-N,N',diorthohydroxyphenylacetic acid (EDDHA), ethylenediamine-N,N',diorthohydroxyparamethylphenylacetic acid (EDDHMA), ethlenediamine-N,N'-disuccinic acid (EDDS), N,N'-bis(2-hydroxybenzyl)-ethylenediamine-N,N'-diacetic acid (HBED), N-hydroxyethylethylenediamine, N,N',N'-triacetic acid (HEDTA), imino-N,N-disuccinic acid (IDS), methylglycine-N,N-diacetic acid (MGDA), triethlenetetraamine-N,N,N',N'',N''',N''''-hexaacetic acid (TTHA), and combinations thereof.

In various embodiments, the chelating agent is ethylenediaminetetraacetic acid (EDTA).

In various embodiments, the sacrificial carbon layer includes a dopant selected from the group consisting of calcium (Ca), zinc (Zn), iron (Fe), boron (B), tungsten (W), platinum (Pt), gold (Au), silver (Ag), copper (Cu), chromium (Cr), aluminum (Al), titanium (Ti), nitrogen (N), phosphorous (P), silicon (Si), cobalt (Co), vanadium (V), zirconium (Zr), niobium (Nb), molybdenum (Mo), hafnium (Hf), tantalum (Ta), rhenium (Re), and combinations thereof.

In various embodiments, the sacrificial carbon layer has a thickness from greater than or equal to about 0.250 μm to less than or equal to about 5 μm.

In various embodiments, the seat contacting element further includes a substrate with an adhesive interlayer disposed directly on the substrate, a tungsten carbide carbon (WCC) layer disposed directly on the adhesive interlayer, and the sacrificial carbon layer disposed directly on the WCC layer.

In various embodiments, the seat contacting element is a spherical cap.

In various embodiments, the valve seat has a seat surface complementary to the seat contacting element, wherein the seat surface also includes a sacrificial carbon layer.

In various embodiments, the seat contacting element further includes a substrate having a hardness from about HRC 58 to about HRC 60.

In various embodiments, the sacrificial carbon layer is a silicon-doped carbon layer.

In various embodiments, the silicon-doped carbon layer has a thickness of greater than or equal to about 0.5 μm to less than or equal to about 2 μm, and wherein an amount of silicon ranges from about 1 wt. % to about 15 wt. % of the silicon-doped carbon layer.

In various embodiments, the seat contacting element includes a substrate with chromium interlayer disposed directly on the substrate, a tungsten carbide carbon (WCC) layer disposed directly on the chromium interlayer, and the sacrificial carbon layer disposed directly on the WCC layer.

In various embodiments, the sacrificial carbon layer is to compensate for carbon chemical loss from the seat contacting element due to a reaction with zinc oxide in the fuel.

In various embodiments, the seat contacting element is a spherical cap.

In various embodiments, the valve seat has a seat surface complementary to the seat contacting element.

In various embodiments, the substrate has a hardness from about HRC 58 to about HRC 60.

In various embodiments, the sacrificial carbon layer increases WCC thermal stability by about 100 degrees C., shields heat from a sealing band to the WCC layer due to a lower thermal conductivity of graphitic carbon in the sacrificial carbon layer than that of diamond-like carbon, and reduces physical wear loss due to $SiO_2$ acting as a lubricant.

The current technology also provides a vehicle that includes an internal combustion engine including at least one fuel injector for injecting fuel directly into a combustion chamber. The at least one fuel injector includes an injector body having an inlet, an outlet, and a passageway for fuel to flow from the inlet to the outlet; a movable valve portion movable in the passageway between an open and a closed position; a valve seat defined at the outlet, wherein the movable valve portion is to sealingly engage the valve seat in the closed position and wherein the movable valve portion is to be spaced from the valve seat in the open position to open the fuel injector for the fuel to flow through the outlet; and a seat contacting element defined on the movable valve portion, wherein the seat contacting element includes a sacrificial carbon layer at an outermost surface of the seat contacting element.

In various embodiments, the sacrificial carbon layer further includes a chelating agent.

In various embodiments, the chelating agent is ethylenediaminetetraacetic acid (EDTA).

In various embodiments, the sacrificial carbon layer is a silicon-doped carbon layer.

The current technology also provides a method of protecting a vehicle component from corrosion resulting from contact with fuel containing ethanol. The method includes disposing a sacrificial carbon layer on a surface of a vehicle component that is configured to contact fuel containing ethanol and zinc ions; and contacting the surface of the vehicle part having the sacrificial carbon layer to fuel containing ethanol. The sacrificial carbon layer includes carbon that complexes and solubilizes ZnO deposited on the surface, wherein the ZnO forms from the zinc ions carried by the fuel.

In various embodiments, the vehicle component is a fuel injector, an intake valve, an exhaust valve, a cylinder, a piston, a spark plug, a fuel pump, a sending unit, a fuel tank, a ring, a gasket, or a combination thereof.

In various embodiments, the disposing is performed by a process selected from the group consisting of filtered cathodic vacuum arc, ion beam deposition, plasma enhanced chemical vapor deposition, pulsed laser deposition, plasma immersion ion implantation, and combinations thereof.

In various embodiments, the disposing a sacrificial carbon layer comprises disposing a sacrificial carbon layer having a thickness of greater than or equal to about 250 nm to less than or equal to about 5 μm to a surface of a vehicle component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
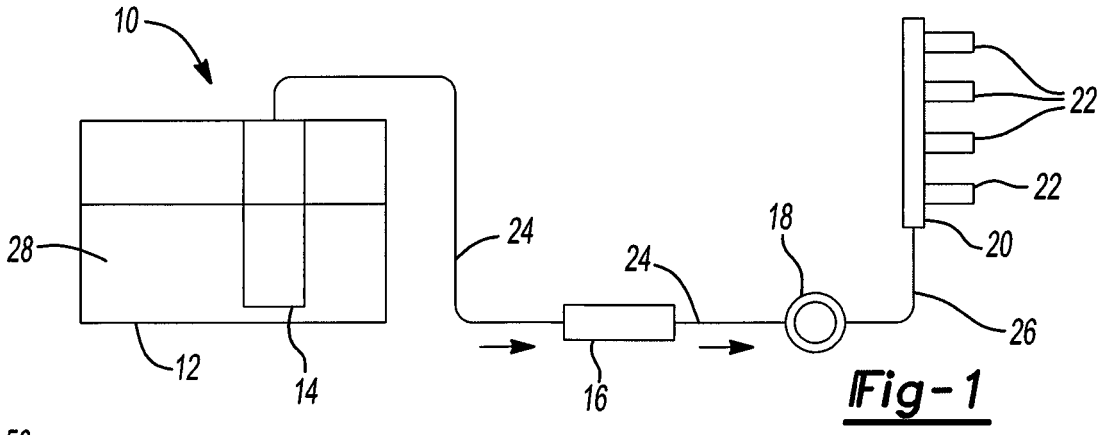
FIG. 1 is a schematic illustration of an exemplary fuel delivery system.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

As used herein, the terms "composition" and "material" are used interchangeably to refer broadly to a substance containing at least the preferred chemical constituents, elements, or compounds, but which may also comprise additional elements, compounds, or substances, including trace amounts of impurities, unless otherwise indicated. In addition, disclosure of ranges includes disclosure of all values and further divided ranges within the entire range, including endpoints and sub-ranges given for the ranges.

Example embodiments will now be described more fully with reference to the accompanying drawings.

Ethanol-blended fuels and various fuel additives have corrosive properties and potentially can damage vehicle components that they contact, especially in combination with thermal stress. In particular, ion contamination has a deleterious effect on vehicle components that contact ethanol-blended fuels. Ion contamination includes the presence of zinc, iron, chromium, copper, and nickel ions, as non-limiting examples, in ethanol-blended fuels and fuel delivery systems that precipitate and deposit on surfaces of fuel delivery system components that directly contact ethanol-blended fuel. For example, zinc (Zn) ions contribute to corrosion and delamination of tungsten carbide carbon (WCC) layers that are disposed on surfaces of various vehicle components that contact ethanol-blended fuels. Zinc ions may come from ethanol-blended fuel, from fuel delivery pathways (e.g., filters in injector passageways), from zinc-based coatings on surfaces of vehicle components that contact ethanol-blended fuel, or combinations thereof. Therefore, the ethanol-blended fuel may include small amounts of zinc, which may originate from zinc coatings or the ethanol-containing fuel may itself contain zinc (e.g., from zinc ions that get deposited as zinc oxide (ZnO)). The zinc from the ethanol-containing fuel may be deposited on vehicle components, which potentially results in corrosion and delamination.

Accordingly, the present technology provides vehicle components that are protected from thermal damage and corrosive damage resulting from contact with fuels comprising ethanol and/or fuels comprising corrosive additives. In particular, a sacrificial carbon layer is disposed on at least a portion of surfaces of vehicle components that contact ethanol-blended fuels. The surfaces can be surfaces of the components or surfaces of protective layers (e.g., WCC layers) disposed on the components. As discussed in more detail below, the sacrificial carbon layer reacts with and eliminates contaminants that can damage vehicle components that contact ethanol-blended fuel. The sacrificial carbon layer is thermally stable at temperatures emitted from running engines and minimizes corrosion and delamination to help protect vehicle components from ethanol-blended fuel-induced corrosion and delamination. For instance, the sacrificial carbon layer withstands temperatures of less than or equal to about 450° C., of less than or equal to about 400° C., of less than or equal to about 350° C., or of less than or equal to about 300° C. The sacrificial carbon layer provides excellent thermal and chemical inertness to corrosive fluids and reduces friction and wear to vehicle components that are subjected to thermal stress and/or contact with corrosive fluids, such as ethanol-blended fuels and corrosive additives. Because the sacrificial carbon layer minimizes or protects against corrosion, which inhibits fuel leaks, emissions may also be improved.

As used herein, "ethanol-blended fuels" are fuels that comprise ethanol. Therefore, ethanol-blended fuels include greater than or equal to about 0.5% ethanol by volume to less than or equal to 100% ethanol by volume. Some ethanol-blended fuels comprise less than 100% ethanol and also comprise gasoline. Non-limiting examples of ethanol-blended fuels include E5 (5% ethanol), E7 (7% ethanol), E10 (10% ethanol), E20 (20% ethanol), E22 (22% ethanol), E25 (25% ethanol), E70 (70% ethanol), E75 (75% ethanol), E85 (85% ethanol), E95 (95% ethanol), and E100 (100% ethanol) fuels.

Vehicles that have components that come in contact with ethanol-blended fuel are not limited. Nonetheless, exemplary vehicles include cars, trucks, recreational vehicles, motorcycles, scooters, boats, personal watercraft, tanks, and airplanes.

Figure 2:
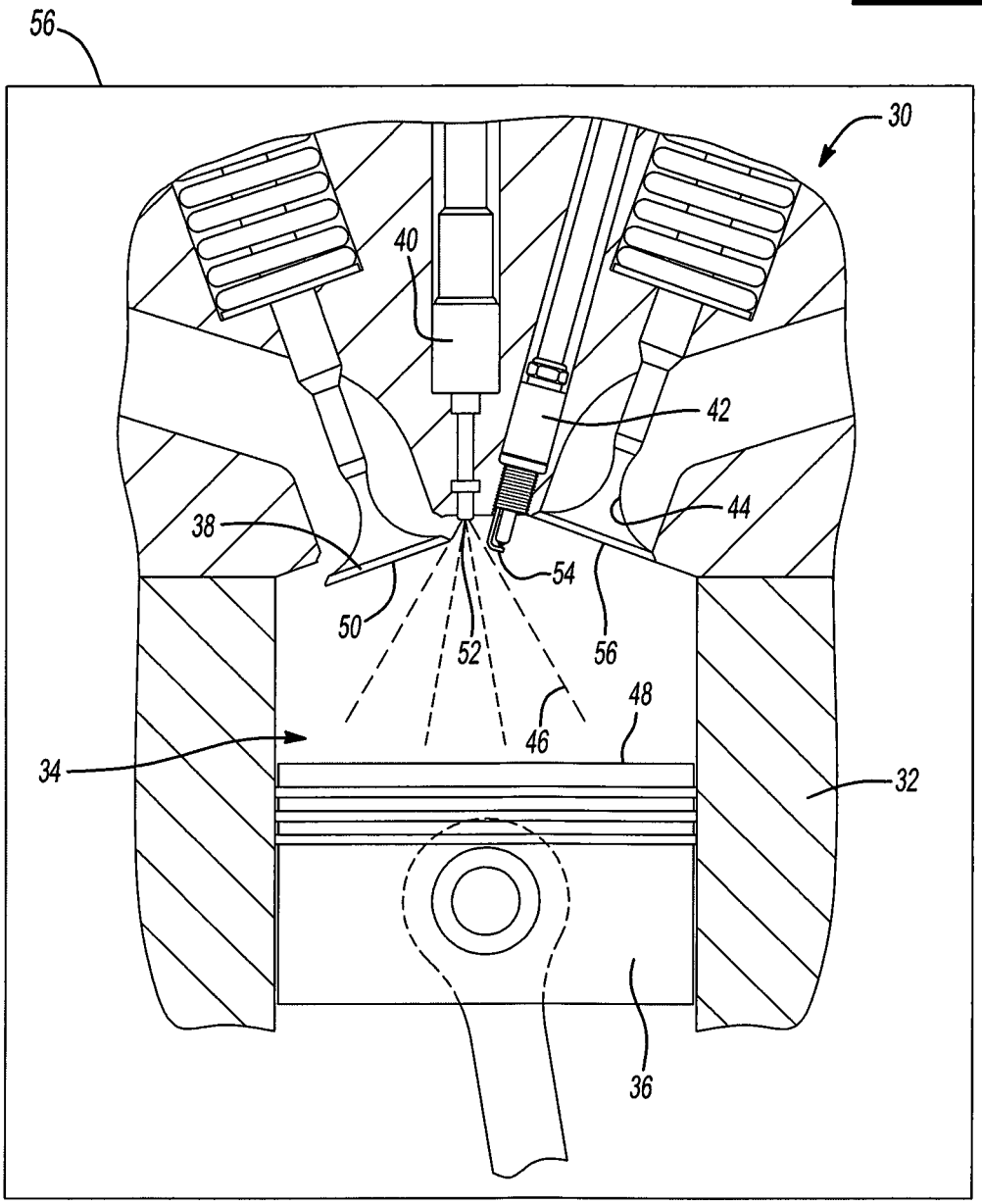
FIG. 2 is an illustration of a vehicle and a cross sectional view of a portion of an internal combustion engine.

Ethanol-blended fuels are introduced to internal combustion engines by fuel delivery systems. FIG. 1 is an illustration of an exemplary fuel delivery system 10. The fuel delivery system 10 includes components such as a fuel tank 12, a fuel pump or sending unit 14, a fuel filter 16, a high pressure fuel pump 18, a fuel rail 20, and fuel injectors 22. The fuel pump or sending unit 14 is disposed in the fuel tank 12 and is in fluid communication with the fuel filter 16 and the high pressure fuel pump 18 by way of fuel lines 24. The high pressure fuel pump 18 is in fluid communication with the fuel rail 20 by way of a high pressure fuel line 26. Ethanol-blended fuel 28 travels in the direction of the arrows from the fuel tank 12 to and through the fuel injectors 22. Ion contaminants can be present in the ethanol-blended fuel or picked up and carried by the ethanol-blended fuel from any of the fuel system components. Especially in environments that are subjected to thermal stress, the ions precipitate onto surfaces of the components and cause corrosion, such as delamination. Therefore, in various aspects of the current technology, at least a portion of these components that contact fuel comprising ethanol comprise a sacrificial carbon layer disposed thereon that protects the components from corrosion. The sacrificial carbon layer inhibits corrosion, which results in improved vehicle part efficiency relative to components that do not include sacrificial carbon layers. For example, fuel rails and fuel injectors with sacrificial carbon layers disposed on portions that contact fuel comprising ethanol are protected from wear and can withstand high internal pressures and temperatures FIG. 2 shows a cross-section of a portion of an exemplary internal combustion engine 30 that includes a portion of an engine block 32, a cylinder 34, a piston 36, an intake valve 38, a fuel injector 40, a spark plug 42, and an exhaust valve 44. The section of the internal combustion engine 30 depicted in FIG. 2 is part of a spark ignited direct injection four stroke internal combustion engine. After atomized ethanol-blended fuel 46 is introduced to the cylinder 34 by the fuel injector 40, the atomized ethanol-blended fuel 46 comes into contact at least with a portion of a first surface 48 of the piston 36, a second surface 50 of the intake valve 38, a third surface 52 of the fuel injector 40, a fourth surface 54 of the spark plug 42, and a fifth surface 56 of the exhaust valve 44. The internal combustion engine 30 is placed within a vehicle 58. Therefore, disposing a sacrificial carbon layer on a portion or all of the first surface 48, the second surface 50, the third surface 52, the fourth surface 54, and the fifth surface 56, as well as to rings and gaskets, protects the respective components from ethanol-blended fuel-induced corrosion. In various embodiments, the vehicle components comprise a steel alloy or a ceramic.

Figure 3:
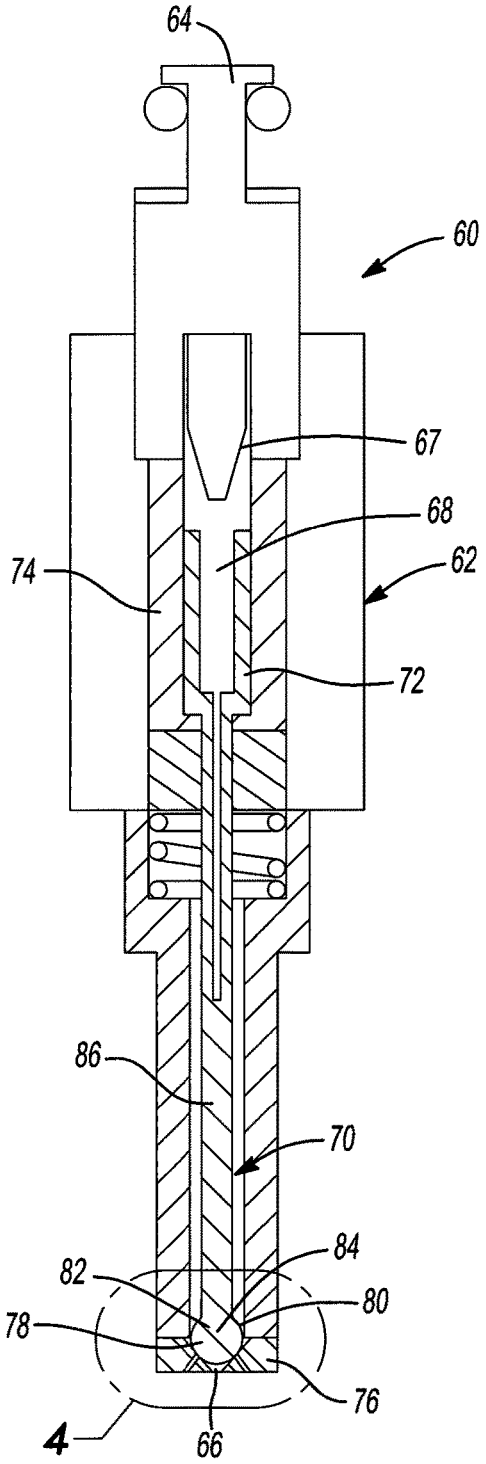
FIG. 3 is a cross-sectional view of an exemplary direct injection fuel injector.

Fuel injectors are particularly susceptible to corrosion and delamination resulting from ion contamination and thermal stress. Therefore, components of fuel injectors that have surfaces that contact ethanol-blended fuels may benefit from having a sacrificial carbon layer disposed thereon. FIG. 3 is a semi-schematic cross-sectional view of an exemplary direct injection fuel injector 60. The fuel injector 60 for an internal combustion engine, such as the internal combustion engine 30 of FIG. 2 includes an injector body 62 having an inlet 64, an outlet 66, and a passageway 68 for ethanol-blended fuel to flow from the inlet 64 to the outlet 66. As shown in FIG. 2, a filter 67 is disposed within the passageway. A movable valve portion 70 is disposed in the passageway 68 and translates between an open position and a closed position. The fuel injector 60 has an armature 72 operated by a solenoid 74. Electromagnetic force is generated by current flow from an electronic controller (not shown) through the solenoid 74. Movement of the armature 72 moves the movable valve portion 70, which is connected to the armature 72.

A valve seat 76 is defined at the outlet 66. The movable valve portion 70 is to sealingly engage the valve seat 76 in the closed position. As used herein, the term "sealingly engage" means that the movable valve portion 70 contacts the valve seat 76 to prevent leakage when the movable valve portion 70 is in the closed position. Leakage is defined as flowing more than 2.5 $mm^3$/minute of N-heptane at a pressure of 5 MPa in an operating temperature range of greater than or equal to about −40° C. to less than or equal to about 150° C.

In an open position (not shown), the movable valve portion 70 is spaced from the valve seat 76 to open the fuel injector 60 enabling the fuel to flow through the outlet 66. A seat contacting element 78 is defined on the movable valve portion 70. An outermost surface 80 of the seat contacting element 78 is subject to corrosion and delamination as it comes in contact with the ethanol-containing fuel that passes by it.

As depicted in FIG. 3, the seat contacting element 78 of the movable valve portion 70 may be a ball valve 82 in certain aspects of the present technology. As such, the seat contacting element 78 may be a spherical cap 84. As used herein, the term "spherical cap" means a region of a sphere which lies above (or below) a given plane. For example, if the plane passes through the center of the sphere, the spherical cap is called a hemisphere.

Further, the movable valve portion 70 may include a needle 86 as depicted in FIG. 3. It is to be understood that seat contacting element 78 may have any suitable shape for sealingly engaging and disengaging the valve seat 76. For example, the needle 86 may have a conical end (not shown) in place of the ball valve 82 shown in FIG. 3 and FIG. 4.

Figure 4:
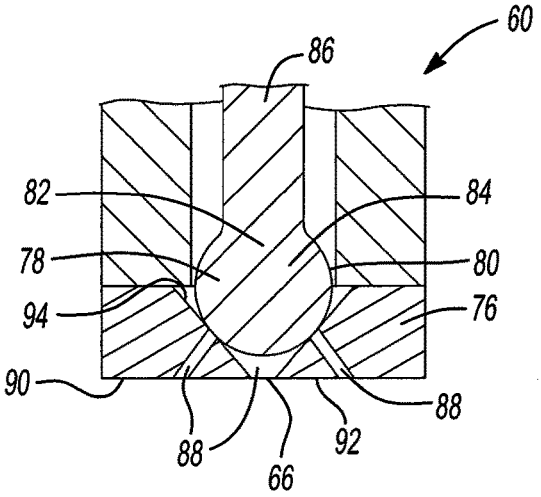
FIG. 4 is an exploded view of the direct injection fuel injector of FIG. 3 taken from section 4.

FIG. 4 is an exploded view of the direct injection fuel injector of FIG. 3 taken from section 4. In the example depicted in FIG. 4, a plurality of seat passages 88 are defined in the valve seat 76. The quantity of seat passages 88 may be adjusted to change the direction and volume of a fuel plume in a cylinder, such as in the cylinder 34 shown in FIG. 2. The seat passages 88 extend through an outer tip surface 90 of the valve seat 76. The outer tip surface 90 is defined on an outlet end 92 of the fuel injector 60.

The valve seat 76 has a seat surface 94 complementary to the seat contacting element 78. As depicted in FIG. 4, the seat surface 94 is conical and sized such that the spherical cap 84 can sealingly contact the seat surface 94. By way of example, if the spherical cap 84 were too large for the seat surface 94, the spherical cap 84 would not be capable of making sealing contact with the seat surface 94. The combination of a spherical cap 84 seat contacting element 78 and a frustoconical seat surface 94 tends to be self-aligning.

Therefore, the present disclosure contemplates disposing a sacrificial carbon layer on a surface of a component of the fuel injector 60 that contacts ethanol-blended fuel protects the component from corrosion. In various aspects of the current technology, a sacrificial carbon layer is disposed on at least the outermost surface 80 of the seat contacting element 42, on the seat surface 94 of the valve seat 76, on the outer tip surface 90 of the outlet 66, on a surface of the needle 86, on a surface of the passageway 68, or a combination thereof.

Figure 5:
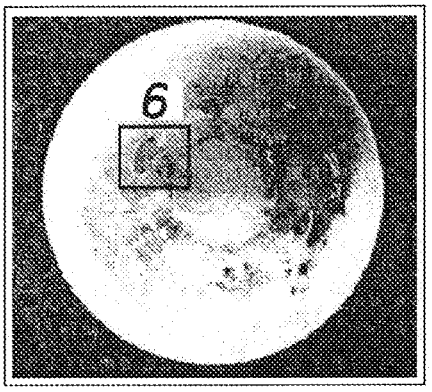
FIG. 5 is a scanning electron micrograph of a portion of an existing seat contacting element of a fuel injector with delamination of the surface.
Figure 6:
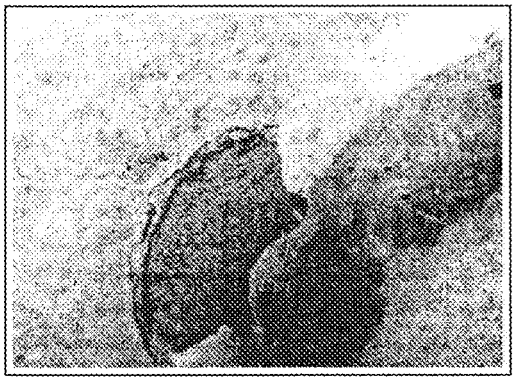
FIG. 6 is a scanning electron micrograph enlargement of the portion of an existing seat contacting element of a fuel injector shown in FIG. 5 taken from section 6, depicting greater detail of the delamination.
Figure 7A:
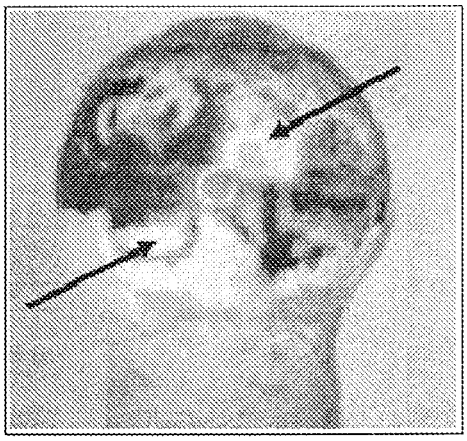
FIG. 7A is a scanning electron micrograph of an existing seat contacting element of a fuel injector with delamination of the surface taken in a first orientation, wherein white contrast (arrows) is deposited ZnO.
Figure 7B:
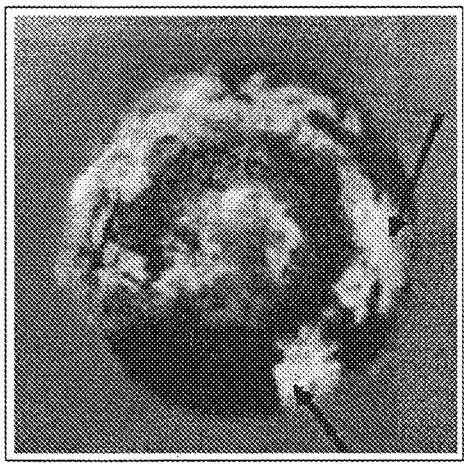
FIG. 7B is a scanning electron micrograph of the seat contacting element shown in FIG. 7A taken in a second orientation, wherein white contrast (arrows) is deposited ZnO.
Figure 7C:
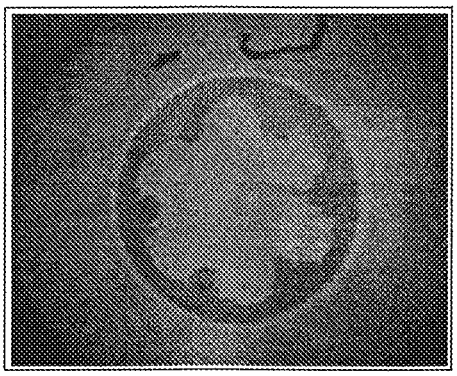
FIG. 7C is a scanning electron micrograph of the seat contacting element shown in FIGS. 7A and 7B, wherein the black contrast shows delamination where tungsten carbide carbon (WCC) was originally present, but now corroded away.

FIG. 5 is a scanning electron micrograph of a portion of an existing seat contacting element of a fuel injector with delamination of the surface that has occurred after exposure to an ethanol-based fuel. FIG. 6 is a scanning electron micrograph enlargement of view 6 as shown in FIG. 5, depicting greater detail of the delamination. In FIG. 6, the steel substrate ball (dark color) is visible through a hole in WCC outer layer and the chromium interlayer. FIGS. 7A-7C are photographs of an existing seat contacting element of a fuel injector with delamination of the surface. The deposits indicated by the arrows are zinc oxide.

As noted above, zinc (Zn) ion contamination may have deleterious effects on fuel injectors and other components of fuel delivery systems that contact ethanol-blended fuels. For example, zinc ions may contribute to delamination of a tungsten carbide carbon (WCC) layer on a seat contacting element of a fuel injector that does not have the sacrificial carbon layer of the present disclosure to protect the WCC layer. The zinc ions may come from fuel and/or from fuel delivery pathways (e.g., filters 67 in the injector passageway 68 as shown in FIG. 3). Zinc-based coatings may be used for corrosion protection of fuel tanks and lines. A small amount of the zinc ions may be carried along with the fuel. Zinc oxide (ZnO) can be deposited on vehicle components from zinc ions carried by fuel.

The sacrificial carbon layer of the current technology is disposed on and protects fuel delivery system components, such as fuel injector seat contacting elements from delamination by converting ZnO to $ZnCO_3$ and hydrogen gas. The ZnO is believed to react with carbon through the following series of reactions (wet chemistry):

$C+H_2O=CO+H_2$; $CO+H_2O=CO_2+H_2$ (Carbon oxidation);

$ZnO+2OH^-+H_2O=Zn(OH)_4^{2-}$ (Complexation);

$CO_2+Zn(OH)_4^{2-}=ZnCO_3+2OH^-+H_2O$ (Carbonation);

The overall reaction is thus: $C+ZnO+2H_2O=ZnCO_3+2H_2$, where complexation is the conversion of insoluble ZnO to soluble $Zn(OH)_4^{2-}$ to increase surface available for reaction.

In various aspects of the current technology, a sacrificial carbon layer protects the carbon in WCC composite layers so that a prolonged life of injector tips is attainable. The sacrificial carbon layer may be made with varying graphitic character and diamond-like character by adjusting deposition parameters (without need for additional tooling) to allow for quick implementation. Accordingly, in various aspects of the current technology, the sacrificial carbon layer is diamond like carbon (DLC). Non-limiting examples of deposition parameters that may be adjusted are: precursors; deposition time and temperature; gas and flow rate; bias current, etc.

DLC is a carbon-based material comprising a network of carbon-carbon $sp^2$ hybrid bonds, carbon-carbon $sp^3$ hybrid bonds, or both carbon-carbon $sp^2$ hybrid bonds and carbon-carbon $sp^3$ hybrid bonds. When both $sp^2$ and $sp^3$ bonds are present, the lower a carbon-carbon $sp^3$ hybrid bond:carbon-carbon $sp^2$ hybrid bond ratio (or higher $sp^2$%), the more graphite-like the DLC material becomes. Conversely, the higher the carbon-carbon $sp^3$ hybrid bond:carbon-carbon $sp^2$ hybrid bond ratio (or higher $sp^3$%), the more diamond-like the DLC material becomes.

A DLC material that contains a high hydrogen content, i.e., a hydrogen content of greater than about 40 atomic % (at. %) is referred to as hydrogenated DLC (H-DLC), wherein "at. %" refers to a percent of total atoms in the DLC material. Conversely, DLC material that contains a low hydrogen content, i.e., a hydrogen content of less than or equal to about 40 at. %, is referred to as non-hydrogenated-DLC (NH-DLC). The NH-DLC materials have a hydrogen content of greater than or equal to 0 at. % to less than or equal to about 40 at. %, less than or equal to about 30 at. %, less than or equal to about 20 at. %, less than or equal to about 10 at. %, less than or equal to about 5 at. %, or less than or equal to about 1 at. %. Therefore, NH-DLC materials have a hydrogen content of greater than or equal to about 0 at. % to less than or equal to about 40 at. %. In various aspects of the current technology, the NH-DLC material is substantially free of hydrogen, wherein "substantially free of hydrogen" means that hydrogen atoms are absent to the extent that undesirable and/or detrimental effects attendant with its presence are avoided. In certain embodiments, a NH-DLC material that is "substantially free" of hydrogen comprises less than about 1 at. % by weight of hydrogen in the material, optionally less than about 0.75 at. % by weight, optionally less than about 0.5 at. % by weight, optionally less than about 0.25 at. % by weight, optionally less than about 0.1 at. % by weight, optionally less than about 0.05 at. % and in certain embodiments, the material is free from any hydrogen and therefore comprises 0 at. % by weight hydrogen. Therefore, the sacrificial carbon layer of the current technology may include a H-DLC material or a NH-DLC material, which are generically referred to as "DLC materials."

In various aspects of the current technology, the DLC material comprises a carbon content of from greater than or equal to about 70 at. % to less than or equal to about 100 at. %. For example, the DLC material can have a carbon content of greater than or equal to about 70 at. %, greater than or equal to about 75 at. %, greater than or equal to about 80 at. %, greater than or equal to about 85 at. %, greater than or equal to about 90 at. %, greater than or equal to about 95 at. %, or greater than or equal to about 99 at. %.

In various aspects of the current technology, the DLC material comprises a carbon-carbon $sp^3$ hybrid bond content of greater than or equal to about 1%, greater than or equal to about 10%, greater than or equal to about 20%, greater than or equal to about 30%, greater than or equal to about 40%, greater than or equal to about 50%, greater than or equal to about 60%, greater than or equal to about 70%, greater than or equal to about 80%, greater than or equal to about 90%, or greater than or equal to about 95% of the total number to $sp^3$ and $sp^2$ hybrid bonds, such as a carbon-carbon $sp^3$ hybrid bond content of from greater than or equal to about 1% to less than or equal to about 100%, greater than or equal to about 20% to less than or equal to about 100%, greater than or equal to about 30% to less than or equal to about 100%, greater than or equal to about 40% to less than or equal to about 100%, greater than or equal to about 50% to less than or equal to about 100%, greater than or equal to about 60% to less than or equal to about 100%, greater than or equal to about 70% to less than or equal to about 100%, greater than or equal to about 80% to less than or equal to about 100%, greater than or equal to about 90% to less than or equal to about 100%, or greater than or equal to about 95% to less than or equal to about 100%.

In various aspects of the current technology, the DLC material comprises a carbon-carbon $sp^2$ hybrid bond content of greater than or equal to about 0%, greater than or equal to about 10%, greater than or equal to about 20%, greater than or equal to about 30%, greater than or equal to about 40%, greater than or equal to about 50%, greater than or equal to about 60%, greater than or equal to about 70%, greater than or equal to about 80%, greater than or equal to about 90%, or greater than or equal to about 95% of the total number to $sp^3$ and $sp^2$ hybrid bonds, such as a carbon-carbon $sp^2$ hybrid bond content of from greater than or equal to about 0% to less than or equal to about 99%, greater than or equal to about 0% to less than or equal to about 95%, greater than or equal to about 0% to less than or equal to about 90%, greater than or equal to about 0% to less than or equal to about 80%, greater than or equal to about 0% to less than or equal to about 70%, greater than or equal to about 0% to less than or equal to about 60%, greater than or equal to about 0% to less than or equal to about 50%, greater than or equal to about 0% to less than or equal to about 40%, greater than or equal to about 0% to less than or equal to about 30%, greater than or equal to about 0% to less than or equal to about 20%, greater than or equal to about 0% to less than or equal to about 10%, greater than or equal to about 0% to less than or equal to about 5%, greater than or equal to about 0% to less than or equal to about 1%.

In various aspects of the current technology, the DLC material comprises a carbon-carbon $sp^3$ hybrid bond:carbon-carbon $sp^2$ hybrid bond ratio of from greater than or equal to about 1:1000 to less than or equal to about 1000:1, of from greater than or equal to about 1:750 to less than or equal to about 750:1, of from greater than or equal to about 1:500 to less than or equal to about 500:1, of from greater than or equal to about 1:250 to less than or equal to about 250:1, of from greater than or equal to about 1:100 to less than or equal to about 100:1, of from greater than or equal to about 1:50 to less than or equal to about 50:1.

In some aspects of the current technology, the sacrificial carbon layer further includes a chelating agent. It is to be understood that any suitable chelating agent may be used. Non-limiting examples of suitable chelating agents include ethylenediaminetetraacetic acid (EDTA), ethylene glycol-bis(β-aminoethyl ether)-N,N,N',N'-tetraacetic acid (EGTA), diethylenetriaminepentaacetic acid (DTPA), N,N-bis(carboxymethyl)glycine (NTA) glutamic acid, N,N-diacetic acid (GLDA), hydroxyethylethylenediaminetriacetic acid (HEDTA), ethanoldiglycinic acid (EDG), 1,3-propylenediaminetetraacetic acid (PDTA), glucoheptonic acid, aspartic acid-N,N-diacetic acid (ASDA), 1,2-diaminocyclohexane-N,N,N',N'-tetraacetic acid (CDTA), ethylenediamine-N,N',diorthohydroxyphenylacetic acid (EDDHA), ethylenediamine-N,N',diorthohydroxyparamethylphenylacetic acid (EDDHMA), ethlenediamine-N,N'-disuccinic acid (EDDS), N,N'-bis(2-hydroxybenzyl)-ethylenediamine-N,N'-diacetic acid (HBED), N-hydroxyethylethylenediamine, N,N',N'-triacetic acid (HEDTA), imino-N,N-disuccinic acid (IDS), methylglycine-N,N-diacetic acid (MGDA), triethlenetetraamine-N,N,N',N'',N''',N'''-hexaacetic acid (TTHA), and combinations thereof.

According to various aspects of the current technology, the sacrificial carbon layer is doped with a metal, metalloid, or nonmetal doping material to generate a doped sacrificial carbon layer. The doping material is, for example, calcium (Ca), zinc (Zn), iron (Fe), boron (B), tungsten (W), platinum (Pt), gold (Au), silver (Ag), copper (Cu), chromium (Cr), aluminum (Al), titanium (Ti), nitrogen (N), phosphorous (P), silicon (Si), cobalt (Co), vanadium (V), zirconium (Zr), niobium (Nb), molybdenum (Mo), hafnium (Hf), tantalum (Ta), rhenium (Re), or a combination thereof. When present, the sacrificial carbon layer has a doping material concentration of from greater than 0 wt. % to less than or equal to about 30 wt. %, to less than or equal to about 20 wt. %, to less than or equal to 10 wt. %, or to less than or equal to about 5 wt. %. In some embodiments, the sacrificial carbon layer is a silicon-doped carbon layer. It is to be understood that the silicon-doped carbon layer may have any thickness and silicon content as desired and/or suitable for a desired end use. In an example, the silicon-doped carbon layer has a thickness ranging from about 0.5 μm to about 2 μm, and an amount of silicon ranges from greater than or equal to about 1 wt. % to less than or equal to about 15 wt. % of the silicon-doped carbon layer.

Figure 8:
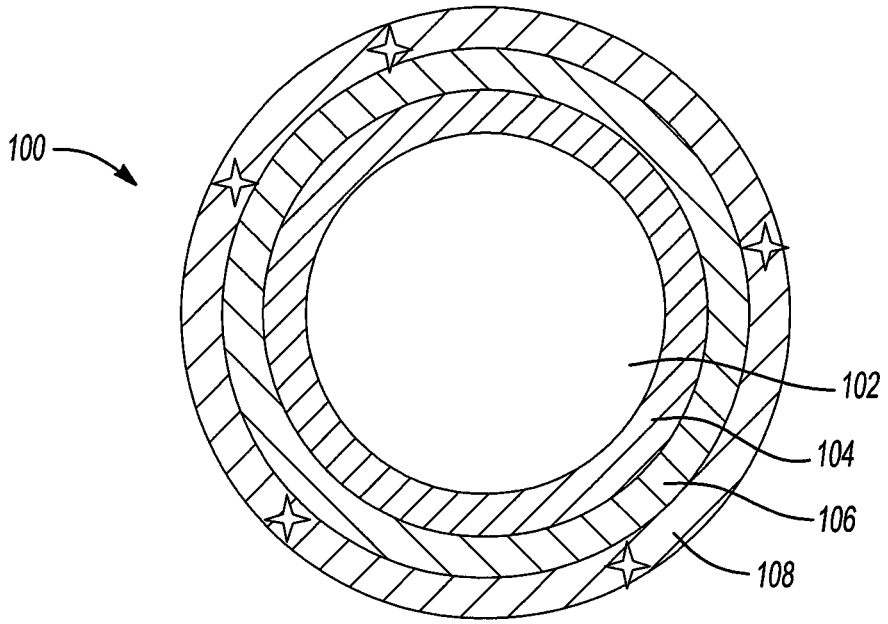
FIG. 8 is a cross sectional view of a vehicle component including a sacrificial carbon layer according to various aspects of the current technology.
Figure 9:
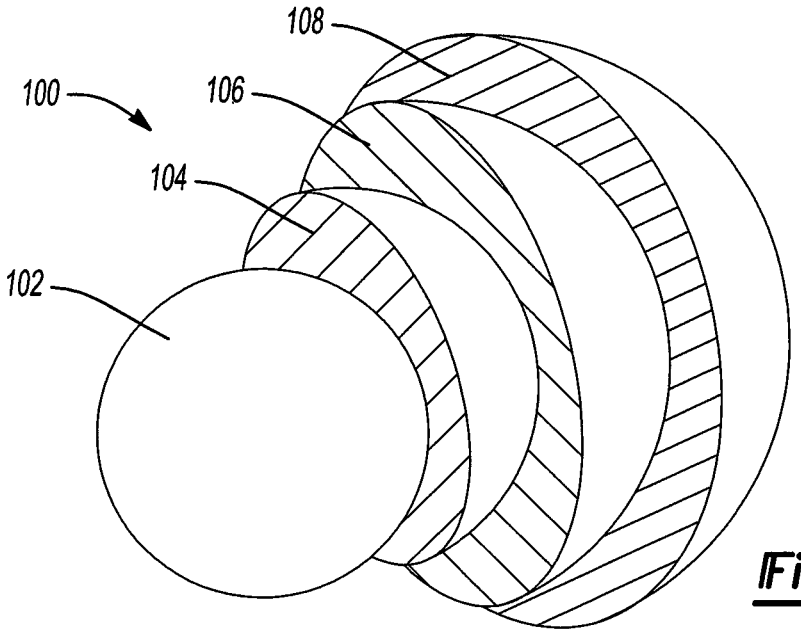
FIG. 9 is a perspective cutaway view of the vehicle component shown in FIG. 8.

The sacrificial carbon layer can be disposed directly on a surface of a vehicle component or directly on a surface of a protective layer disposed on a vehicle component, for example, by way of an adhesive layer. FIG. 8 is a semi-schematic cross sectional view of a vehicle component 100 that contacts ethanol-blended fuel. In particular, the vehicle component 100 is a seat contacting element of a fuel injector. While the seat contacting element is representative, it should be noted that all components of fuel delivery systems that contact ethanol-blended fuel are contemplated by the current technology. FIG. 9 is a perspective cutaway view of the seat contacting element 100. As depicted in FIGS. 8 and 9, the seat contacting element 100 includes a substrate 102. The substrate 102 is composed of any material known in the art, such as, for example, steel alloy or ceramic. In various aspects of the current technology, the substrate may have a hardness of greater than or equal to about HRC 58 to less than or equal to about HRC 60. In some embodiments, the substrate comprises tool steel 440C and has a hardness of HRC 58-60. An adhesive layer (such as an adhesive interlayer) 104 is disposed directly on the substrate 102. The adhesive layer 104 has a thickness of greater than or equal to about 10 nm to less than or equal to about 100 nm and comprises an adhesive material, such as, for example, chromium, titanium, platinum, tantalum, nickel, copper, and combinations thereof. A protective layer 106 is disposed directly on the adhesive layer 104. The protective layer 106 has a thickness of greater than or equal to about 100 nm to less than or equal to about 10 μm, of greater than or equal to about 500 nm to less than or equal to about 5 μm, or from greater than or equal to about 1 μm to less than or equal to about 2 μm, such as, for example, a thickness of about 1.5 μm. In various embodiments, the protective layer 106 comprises tungsten carbide carbon (WCC) disposed directly on the adhesive layer 104. A sacrificial carbon layer 108 is disposed directly on the protective layer 106. The sacrificial carbon layer 108 has a thickness of greater than or equal to about 250 nm to less than or equal to about 5 μm, or greater than or equal to about 500 nm to less than or equal to about 2 μm. The sacrificial carbon layer 108 can include at least one of a chelating agent and a dopant as discussed above.

In various embodiments, as depicted in FIGS. 8 and 9, the substrate 102 may be a spherical cap. In one variation, the spherical cap has a diameter of about 3 mm. The interlayer 104 may comprise chromium and be about 100 nm thick. The protective layer 106 may comprise WCC and be from about 1.0 μm to about 1.5 μm thick. The sacrificial carbon layer 108 may be Si-doped carbon. In such examples, the Si-doped carbon layer 108 may be from about 0.5 μm to about 2 μm thick when the fuel injector is new and has not experienced any depletion of the sacrificial carbon layer 108.

It is to be understood that the sacrificial carbon layer 108 of the present disclosure is multi-functional. Some of these functions include, but are not limited to the following. The sacrificial carbon layer 108 may compensate for carbon chemical loss from a seat contacting element due to carbon from the seat contacting element reacting with zinc oxide (ZnO) derived from zinc ions carried in the fuel. The sacrificial carbon layer may also: increase WCC thermal stability, e.g., by about 100° C.; shield heat from the sealing band to WCC due to a lower thermal conductivity of graphitic carbon than that of diamond-like carbon; and reduce physical wear loss due to $SiO_2$ acting as a lubricant. The silica ($SiO_2$) may be generated during operation of the engine through reacting with $H_2O$ which may be present in ethanol fuels.

Examples of the present disclosure provide a low-cost and implementable strategy (e.g., no additional tooling needed) for mitigating tip leakage. Further, examples of the present disclosure may extend the life of the WCC coating due to the sacrificial carbon layer which provides long-term tolerance for carbon loss. Examples of the present disclosure may be used with vehicles running on biofuels, e.g., E100.

The current technology also provides a method of protecting a vehicle part from thermal and corrosive damage resulting from contact with fuel comprising ethanol. The method comprises disposing a sacrificial carbon layer on at least a portion of a surface of a vehicle component that is configured to contact fuel comprising ethanol, and contacting the at least a portion of the surface of the vehicle component having the sacrificial carbon layer to fuel comprising ethanol. The sacrificial carbon layer comprises carbon that complexes and solubilizes ZnO carried deposited from the fuel comprising ethanol and zinc ions. The vehicle component is a fuel injector, an intake valve, an exhaust valve, a cylinder, a piston, a spark plug, a fuel pump, a sending unit, a fuel tank, a ring, a gasket, or a combination thereof. In various aspects of the current technology, the vehicle component is a component of a fuel injector described herein. The disposing is performed by filtered cathodic vacuum arc, ion beam deposition, plasma enhanced chemical vapor deposition, pulsed laser deposition, or plasma immersion ion implantation. In some embodiments, the disposing a layer comprises disposing a sacrificial carbon layer having a thickness of greater than or equal to about 250 nm to less than or equal to about 5 μm of a surface of a vehicle component.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel injector for an internal combustion engine, comprising: an injector body having an inlet, an outlet, and a passageway for fuel to flow from the inlet to the outlet; a movable valve portion disposed in the passageway that translates between an open position and a closed position, wherein the movable valve portion defines a seat contacting element comprising a substrate with an adhesive interlayer disposed directly on the substrate, a tungsten carbide carbon (WCC) layer disposed directly on the adhesive interlayer, and an outermost exposed surface comprising a sacrificial carbon layer disposed directly on the WCC layer; and a valve seat defined at the outlet, wherein in the closed position, the movable valve portion sealingly engages with the valve seat and in the open position, the movable valve portion is spaced from the valve seat to open the fuel injector permitting fuel to flow through the outlet; wherein the sacrificial carbon layer further includes a chelating agent selected from the group consisting of ethylenediaminetetraacetic acid (EDTA), ethylene glycol-bis(β-aminoethyl ether)-N,N,N',N'-tetraacetic acid (EGTA), diethylenetriaminepentaacetic acid (DTPA), N,N-bis(carboxymethyl) glycine (NTA) glutamic acid, N,N-diacetic acid (GLDA), hydroxyethyl ethyl enediaminetriacetic acid (HEDTA), ethanoldiglycinic acid (EDG), 1,3-propylenediaminetetraacetic acid (PDTA), glucoheptonic acid, aspartic acid-N,N-diacetic acid (ASDA), 1,2-diaminocyclohexane-N,N,N',N'-tetraacetic acid (CDTA), ethylenediamine-N,N',diorthohydroxyphenylacetic acid (EDDHA), ethyl enediamine-N,N',diorthohydroxyparamethylphenylacetic acid (EDDHMA), ethlenediamine-N,N'-disuccinic acid (EDDS), N,N'-bis(2-hydroxybenzyl)-ethylenediamine-N,N'-diacetic acid (HBED), N-hydroxyethylethylenediamine, N,N',N'-triacetic acid (HEDTA), imino-N,N-disuccinic acid (IDS), methylglycine-N,N-diacetic acid (MGDA), triethlenetetraamine-N,N,N',N",N'",N'"-hexaacetic acid (TTHA), and combinations thereof.

2. The fuel injector according to claim 1, wherein the chelating agent is ethylenediaminetetraacetic acid (EDTA).

3. The fuel injector according to claim 1, wherein the sacrificial carbon layer comprises a dopant selected from the group consisting of calcium (Ca), zinc (Zn), iron (Fe), boron (B), tungsten (W), platinum (Pt), gold (Au), silver (Ag), copper (Cu), chromium (Cr), aluminum (Al), titanium (Ti), nitrogen (N), phosphorous (P), silicon (Si), cobalt (Co), vanadium (V), zirconium (Zr), niobium (Nb), molybdenum (Mo), hafnium (Hf), tantalum (Ta), rhenium (Re), and combinations thereof.

4. The fuel injector according to claim 3, wherein the sacrificial carbon layer has a thickness of greater than or equal to about 0.250 μm to less than or equal to about 5 μm.

5. The fuel injector according to claim 1, wherein the seat contacting element is a spherical cap.

6. The fuel injector according to claim 1, wherein the valve seat has a seat surface complementary to the seat contacting element, wherein the seat surface also comprises a sacrificial carbon layer.

7. The fuel injector according to claim 1, wherein the seat contacting element further comprises a substrate having a hardness from about HRC 58 to about HRC 60.

8. A vehicle component comprising:

a surface;

an adhesive layer disposed directly onto the surface;

a protective tungsten carbide carbon (WCC) layer disposed directly on the adhesive layer; and a sacrificial carbon layer disposed directly on the protective WCC layer, the sacrificial carbon layer having a thickness of greater than or equal to about 250 nm to less than or equal to about 5 μm and being configured to contact a fuel comprising ethanol and zinc ions, wherein the sacrificial carbon layer comprises carbon that is configured to complex with and solubilize ZnO deposited on the surface, wherein the ZnO forms from the zinc ions carried by the fuel.

9. The vehicle component according to claim 8, wherein the surface comprises a steel alloy or a ceramic.

10. The vehicle component according to claim 8, wherein the sacrificial carbon layer comprises a dopant selected from the group consisting of calcium (Ca), zinc (Zn), iron (Fe), boron (B), tungsten (W), platinum (Pt), gold (Au), silver (Ag), copper (Cu), chromium (Cr), aluminum (Al), titanium (Ti), nitrogen (N), phosphorous (P), silicon (Si), cobalt (Co), vanadium (V), zirconium (Zr), niobium (Nb), molybdenum (Mo), hafnium (Hf), tantalum (Ta), rhenium (Re), and combinations thereof.

11. The vehicle component according to claim 8, wherein the sacrificial carbon layer comprises a chelator selected from the group consisting of ethylenediaminetetraacetic acid (EDTA), ethylene glycol-bis(β-aminoethyl ether)-N,N,N',N'-tetraacetic acid (EGTA), diethylenetriaminepentaacetic acid (DTPA), N,N-bis(carboxymethyl)glycine (NTA) glutamic acid, N,N-diacetic acid (GLDA), hydroxyethylethylenediaminetriacetic acid (HEDTA), ethanoldiglycinic acid (EDG), 1,3-propylenediaminetetraacetic acid (PDTA), glucoheptonic acid, aspartic acid-N,N-diacetic acid (ASDA), 1,2-diaminocyclohexane-N,N,N',N'-tetraacetic acid (CDTA), ethylenediamine-N,N', di orthohydroxyphenylacetic acid (EDDHA), ethylenediamine-N,N', diorthohydroxyparamethylphenylacetic acid (EDDHMA), ethlenediamine-N,N'-disuccinic acid (EDDS), N,N'-bis(2-hydroxybenzyl)-ethylenediamine-N,N'-diacetic acid (HBED), N-hydroxyethylethylenediamine, N,N',N'-triacetic acid (HEDTA), imino-N,N-disuccinic acid (IDS), methylglycine-N,N-diacetic acid (MGDA), triethlenetetraamine-N,N,N',N",N'",N'"-hexaacetic acid (TTHA), and combinations thereof.

12. The vehicle component according to claim 8, wherein the surface is a surface of a piston, an intake valve, a fuel injector, a spark plug, an exhaust valve, or a combination thereof.

13. The vehicle component according to claim 8, wherein the vehicle component is a fuel injector, an intake valve, an exhaust valve, a cylinder, a piston, a spark plug, a fuel pump, a sending unit, a fuel tank, a ring, a gasket, or a combination thereof.

14. A method of protecting a vehicle component from corrosion resulting from contact with fuel comprising ethanol and carrying zinc ions, the method comprising:

disposing an adhesive layer on a surface of a vehicle component that is configured to contact fuel comprising ethanol and zinc ions;

disposing a protective tungsten carbide carbon (WCC) layer directly on the adhesive layer; and disposing a sacrificial carbon layer directly on the protective WCC layer, the sacrificial carbon layer having a thickness of greater than or equal to about 250 nm to less than or equal to about 5 μm and being configured to contact the fuel comprising ethanol and zinc ions, wherein when the surface of the vehicle component having the sacrificial carbon layer contacts fuel comprising ethanol, carbon in the sacrificial carbon layer complexes and solubilizes ZnO deposited on the surface, wherein the ZnO forms from the zinc ions carried by the fuel.

15. The method according to claim 14, wherein the vehicle component is a fuel injector, an intake valve, an exhaust valve, a cylinder, a piston, a spark plug, a fuel pump, a sending unit, a fuel tank, a ring, a gasket, or a combination thereof.

16. The method according to claim 15, wherein the disposing the sacrificial carbon layer is performed by a process selected from the group consisting of: filtered cathodic vacuum arc, ion beam deposition, plasma enhanced chemical vapor deposition, pulsed laser deposition, plasma immersion ion implantation, and combinations thereof.

17. The method according to claim 15, wherein the disposing the sacrificial carbon layer comprises disposing a sacrificial carbon layer having a thickness of greater than or equal to about 250 nm to less than or equal to about 5 μm to a surface of a vehicle component.

* * * * *